US006186214B1

(12) United States Patent
Ladd et al.

(10) Patent No.: US 6,186,214 B1
(45) Date of Patent: Feb. 13, 2001

(54) APPARATUS, SYSTEM AND METHOD FOR STABILIZING BLINDS

(75) Inventors: Kevin Ladd, Arvada; David Boyer, Castle Rock, both of CO (US)

(73) Assignee: Blind Stay, Inc., Arvada, CO (US)

( * ) Notice: Under 35 U.S.C. 154(b), the term of this patent shall be extended for 0 days.

(21) Appl. No.: 09/345,287

(22) Filed: Jun. 30, 1999

(51) Int. Cl.[7] ..... E06B 9/30

(52) U.S. Cl. ..... 160/178.1 R; 160/168.1 R; 160/173 R; 292/165; 292/DIG. 4

(58) Field of Search ..... 160/167 R, 178.1 R, 160/276, 288, 289, 290.1; 292/DIG. 4, 165

(56) References Cited

U.S. PATENT DOCUMENTS

| | | | | |
|---|---|---|---|---|
| 2,027,570 | * | 1/1936 | Zingg . | |
| 2,061,939 | | 11/1936 | Hammer | 156/17 |
| 2,103,395 | | 12/1937 | Wade et al. | 156/17 |
| 2,181,101 | * | 11/1939 | Spenard . | |
| 2,187,242 | * | 1/1940 | Kesner | 160/288 |
| 2,710,059 | | 6/1955 | Wilson | 160/177 |
| 2,822,868 | | 2/1958 | Roberts | 160/173 |
| 2,901,035 | | 8/1959 | Anderle | 160/178 |
| 3,156,294 | * | 11/1964 | Miller et al. | 160/288 |
| 3,447,586 | | 6/1969 | Anderle | 160/178 |
| 3,552,473 | * | 1/1971 | Persson | 160/167 R |
| 4,088,173 | | 5/1978 | Antich | 160/238 |
| 4,226,455 | | 10/1980 | Hennequin | 292/345 |
| 4,444,239 | * | 4/1984 | Haines . | |
| 4,601,319 | * | 7/1986 | Georopoulos | 160/178.1 R |
| 4,762,161 | | 8/1988 | Anderson | 160/178 |
| 4,823,432 | * | 4/1989 | Jan . | |
| 5,052,460 | | 10/1991 | Buckingham | 160/178.1 |
| 5,067,545 | | 11/1991 | Wilkins et al. | 160/178.1 |
| 5,090,751 | * | 2/1992 | Kobayashi | 292/DIG. 4 |
| 5,211,431 | * | 5/1993 | Koizumi et al. | 292/DIG. 4 |
| 5,282,514 | | 2/1994 | Felcetto | 160/178.1 |
| 5,498,039 | * | 3/1996 | Bivens | 292/DIG. 4 |

* cited by examiner

*Primary Examiner*—Blair M. Johnson
(74) *Attorney, Agent, or Firm*—Townsend and Townsend and Crew, LLP

(57) ABSTRACT

In one embodiment, an apparatus (10) for securing a movable blinds rail (110, 112) to a fixed surface (124) includes a casing (12) having a detent (18) affixed to an inner surface thereof. An elongate rod (20) is included having first (22) and second (26) ends and a protruding member (28) extending from the rod between the ends. The rod first end extends out of a first opening (32) of the casing and the protruding member slidably cooperates with the detent to secure the rod in a first fixed position. In this manner, the apparatus is coupled to the moveable blinds rail, and the rod first end is used to contact a fixed surface to secure the movable blinds rail thereto.

24 Claims, 10 Drawing Sheets

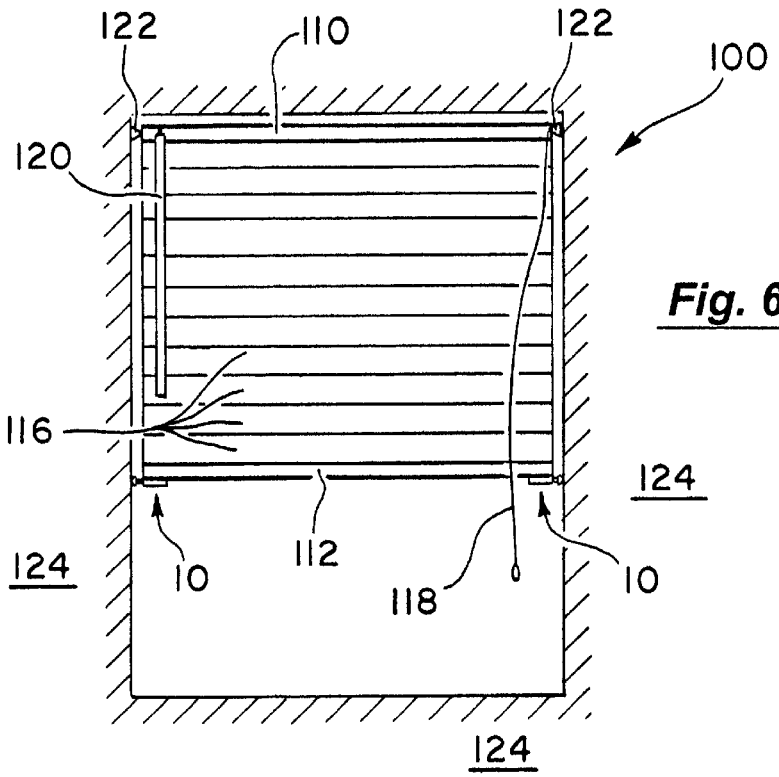
Fig. 6A
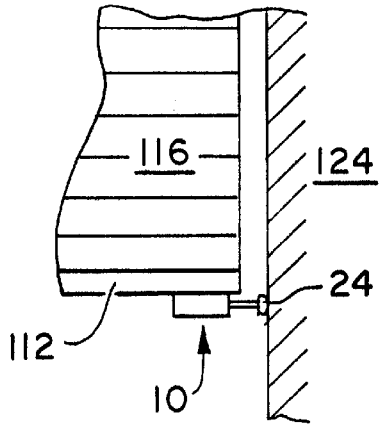
Fig. 6B
Fig. 6C
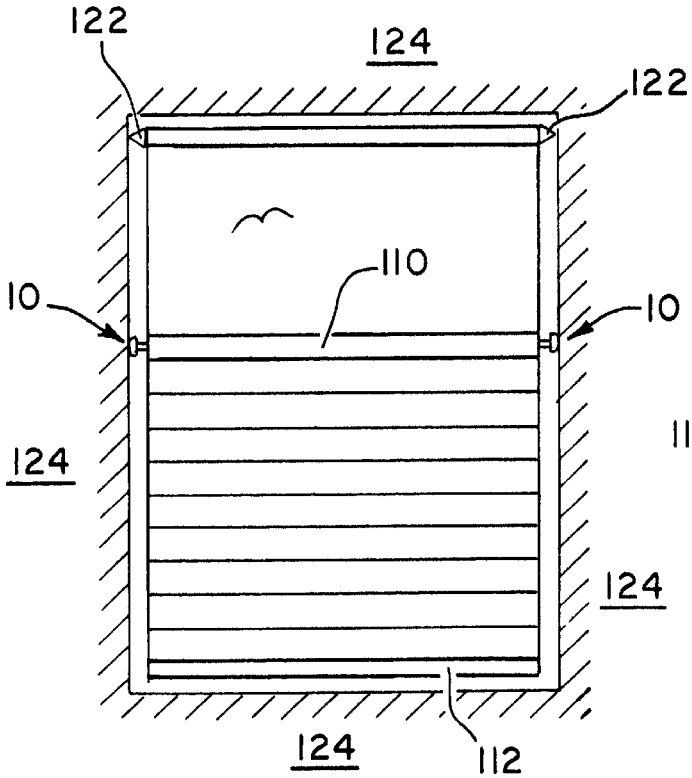
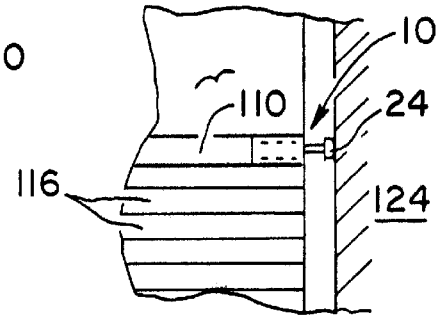
Fig. 6D

APPARATUS, SYSTEM AND METHOD FOR STABILIZING BLINDS

BACKGROUND OF THE INVENTION

The present invention relates to window or door blinds. More particularly, the present invention is directed to apparatus, system and methods for stabilizing blinds, such as window blinds, in a variety of positions.

At one point or another, most people have been awakened or otherwise disturbed by the sound of window blinds banging against a window or window frame on a windy day or night. Window blinds, which include venetian blinds, miniblinds and the like, often are subject to vibration or swaying due to wind or traffic conditions within a room in which the blinds are mounted. In addition to creating undesirable noise, blinds may mar the adjacent wall, window frame or door to which they are mounted.

The prior art attempts to resolve this problem are fraught with additional problems or concerns. For example, prior art devices designed to affix the window blinds to the window frame typically require that they be affixed at a particular location, such as where a bracket is attached to the frame. This is undesirable for individuals who wish to have greater flexibility in the amount that the blinds are raised or lowered prior to their securing against vibrations or the wind. Other devices have undue complexity, are difficult to use, or have other limitations which make them undesirable. Accordingly, it is desirable to provide an apparatus which stabilizes blinds against unwanted movements, and can permit the securing of the blinds in a wide range of desired positions. It is further desirable to have such an apparatus be easy to use.

SUMMARY OF THE INVENTION

The present invention provides exemplary apparatus, systems and methods of affixing or securing movable blinds or end rails to a fixed surface. The present invention is further capable of affixing blinds in a wide range of positions, and is easy to use.

In one embodiment of the present invention, an apparatus for securing a movable blinds rail to a fixed surface includes a casing having a detent affixed to an inner surface thereof. An elongate rod is included having first and second ends and a protruding member extending from the rod between the ends. The first rod end extends out of a first opening of the casing and the protruding member slidably cooperates with the detent to secure the rod in a first fixed position. In this manner, the apparatus is coupled to the moveable blinds rail, and the first rod end is used to contact a fixed surface to secure the movable blinds rail thereto.

In one aspect, the detent is a generally Y-shaped detent. In another aspect, the casing further includes a second opening through which the second rod end extends. In another aspect, the elongate rod further includes a handle extending from between the ends. The handle extends out of the casing through an opening therein. In this manner, the handle may be manipulated to move the elongate rod into the first fixed position.

In one particular aspect, the detent includes a plurality of ramps defining a plurality of grooves. The protruding member slidably cooperates with the ramps and the grooves to position the rod in the first fixed position. Preferably, in another aspect, the protruding member slidably cooperates with the ramps and grooves to position the rod in a second fixed position. In this manner, one fixed position may correlate with the securing of the movable blind rail to a fixed surface, and the other fixed position may correspond to a position which allows the movable blinds rail to be raised, lowered or otherwise moved. This is accomplished, in one aspect, by having the first rod end extend from the casing first and second distances when the first rod end is in the first and second fixed positions, respectively.

In one aspect of the present invention, the apparatus further includes a tension member coupled to the rod near the second end. The tension member is adapted to encourage the protruding member towards the first opening so that the rod is in the first fixed position. Similarly, in one aspect the tension member is adapted to encourage the protruding member towards the first opening so that the rod is in the second fixed position. In one particular aspect, the tension member comprises a spring. In another aspect, the tension member engages an inner edge of the casing to encourage the protruding member towards the first opening.

In still another aspect, the apparatus further includes a tension member coupled to the rod to encourage the protruding member into the detent.

The present invention further provides exemplary blinds systems. In one embodiment, the blinds system includes first and second end rails having a plurality of connected slats therebetween. The system includes a flexible elevating member for changing an elevation of the first end rail, and first and second locking apparatus coupled to opposing ends of the first end rail. Each locking apparatus includes a casing having a detent affixed to an inner surface thereof, and an elongate rod having first and second ends and a protruding member extending from the rod between the ends. The first rod end extends out of a first opening in the casing and the protruding member slidably cooperates with the detent to secure the rod in a first fixed position.

In one aspect, the first end rail is a movable lower end rail. Alternatively, the first end rail is a movable upper end rail.

In one particular aspect, the locking apparatus further includes a tension member coupled to the rod near the second end. The tension member is adapted to encourage the protruding member towards the first opening so that the rod is in the first fixed position. In one aspect, the first rod ends engage opposing fixed surfaces to secure the first end rail thereto when the rods are secured in the first fixed positions. In one aspect, the opposing fixed surfaces comprise opposing surfaces of a window frame.

In one particular aspect, the protruding members slidably cooperate with the detent to secure each of the rods in a second fixed position. The first end rail moves generally freely relative to the opposing fixed surfaces when at least one of the rods is in the second fixed position. In still another aspect, the blinds system further includes a rotation member for rotating the connected slats.

The present invention further provides exemplary methods of securing a movable end rail of a blind system to a fixed surface. In one embodiment, the method includes providing the moveable end rail having a locking apparatus coupled to opposing ends of the movable end rail. Each of the locking apparatus includes a casing having a detent affixed to an inner surface thereof, and an elongate rod having first and second ends and a protruding member extending from the rod between the ends. The first rod end extends out of a first opening of the casing and the protruding member slidably cooperates with the detent to secure the rod in first and second fixed positions. The elongate rod in at least one of the locking apparatus is translated so that the protruding member cooperates with the detent to secure the rod in the second fixed position. The method includes positioning the movable end rail at a desired location and translating the elongate rod in the locking apparatus so that the protruding member cooperates with the detent to secure the rod in the first fixed position so that the first rod ends contact opposing fixed surfaces. In this manner, the movable end rail is secured at the desired location.

In one aspect of the method, each locking apparatus further includes a tension member coupled to the rod near the rod second end. The tension member is adapted to encourage the protruding member towards the first opening so that the rod is in the first fixed position. In another aspect, the detents in the locking apparatus each further include a plurality of ramps defining a plurality of grooves. The protruding members slidably cooperate with the ramps and grooves to position the rod in the first and second fixed positions.

For a further understanding of the objects and advantages of the present invention, reference should be made to the ensuing detailed description taken in conjunction with the accompanying drawings.

BRIEF DESCRIPTION OF THE DRAWINGS

FIGS. 6A and 6C depict overall views of blind systems according to the present invention; and FIGS. 6B and 6D depict close-up views of apparatus used in the systems depicted in FIGS. 6A and 6C, respectively.

DETAILED DESCRIPTION OF THE SPECIFIC EMBODIMENTS

Figure 1A:
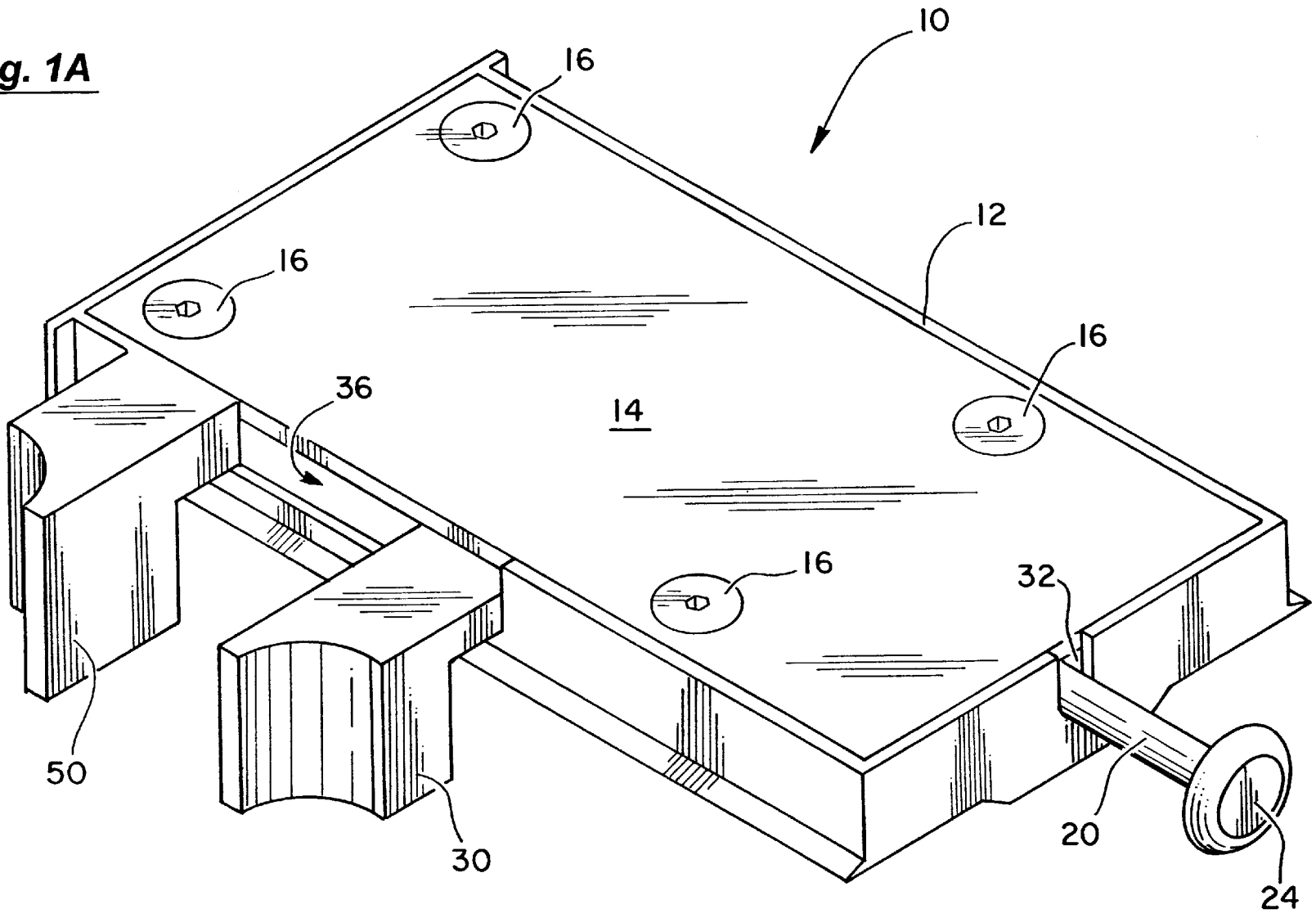
FIGS. 1A and 1B depict an overall view and an exploded overall view, respectively, of one embodiment of an apparatus of the present invention.
Figure 1B:
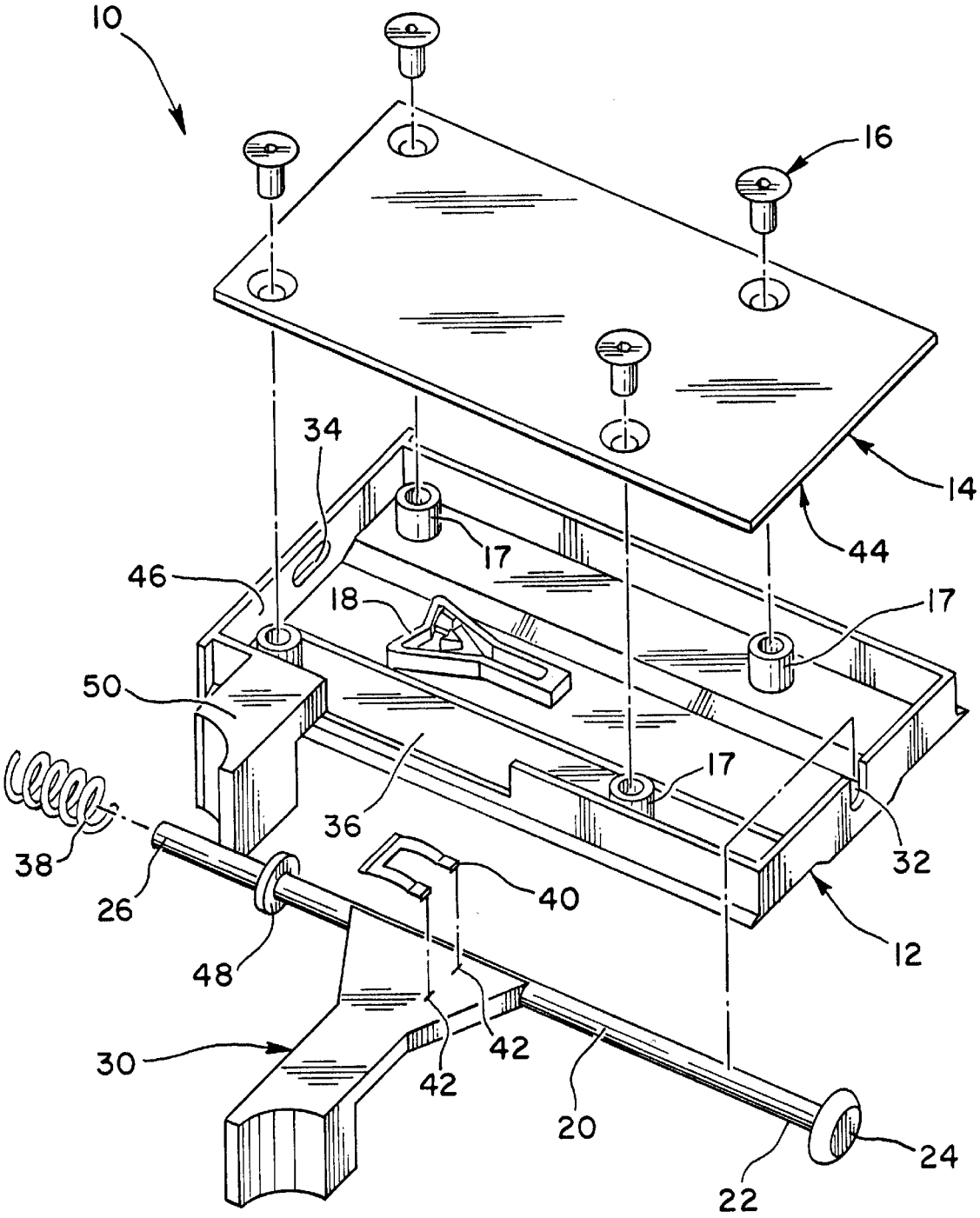
Figure 2:
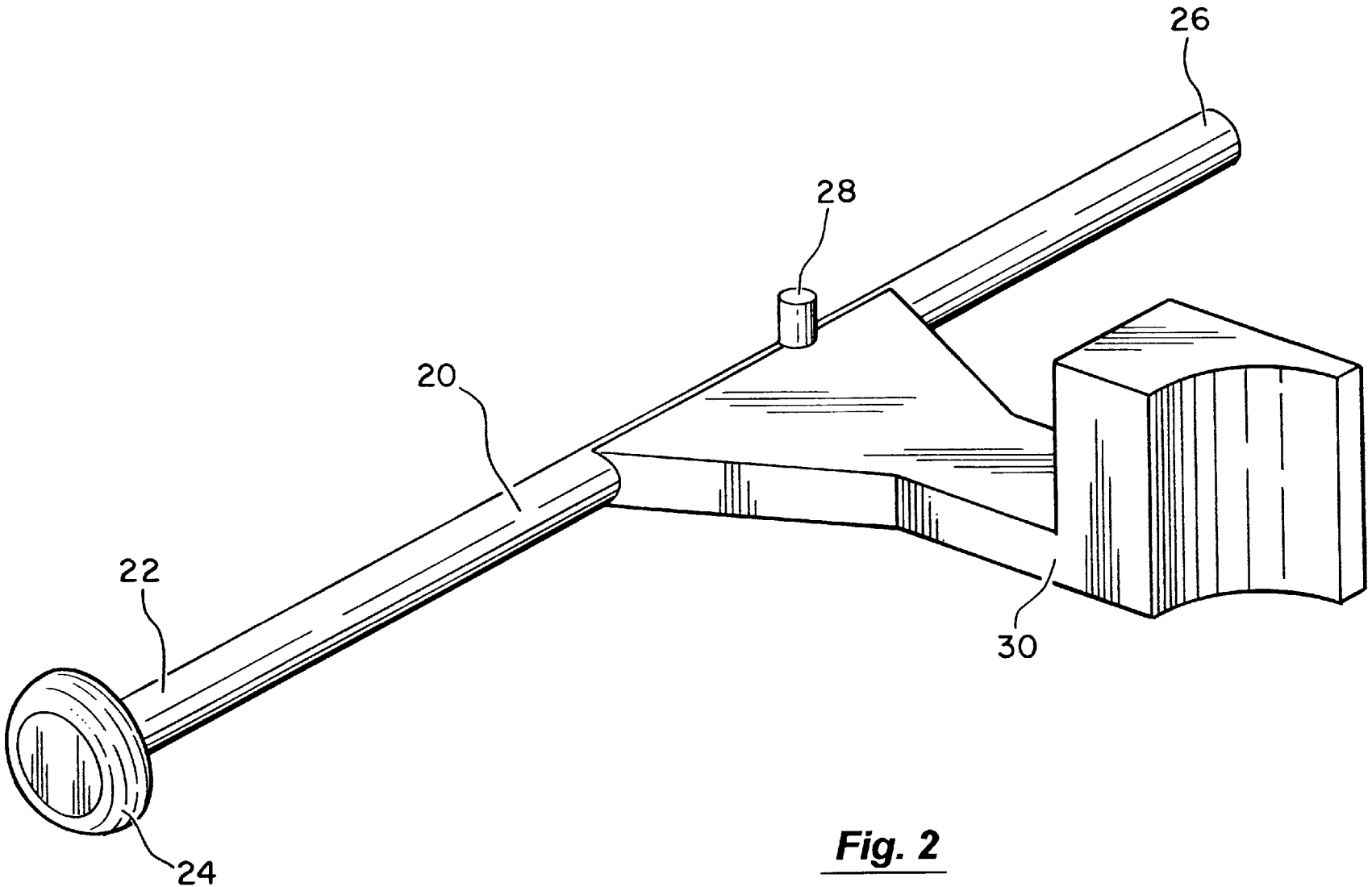
FIG. 2 depicts an elongate rod and protruding member for use with the apparatus depicted in FIGS. 1A–1B.

Turning now to FIGS. 1A, 1B and 2, an exemplary blinds locking apparatus 10 according to the present invention will be described. Apparatus 10 includes a casing 12, having a removable cover 14. As shown in FIGS. 1A and 1B, casing 12 is generally rectangular in shape, however, other shapes may be used within the scope of the present invention. In one embodiment, casing 12 and cover 14 comprise a plastic, although other materials, including metal, may be used within the scope of the present invention.

In one particular embodiment, the length of casing 12 is about 3 inches and the width of casing 12 is between about 1.5 and about 1.75 inches. It will be appreciated by those skilled in the art that the above dimensions are but one of a wide range of sizes of casing 12. Cover 14 is coupled to casing 12 with a plurality of fasteners 16. Fastener 16 may include screws, nails and any variety of fasteners for affixing cover 14 to casing 12. In the embodiment shown in FIG. 1B, fasteners 16 fit into receiving members or pegs 17 on the inside of casing 12. Casing 12 further includes a detent 18 affixed to an inner surface of casing 12. The function of detent 18 will be described in greater detail in conjunction with later figures.

Apparatus 10 further includes a rod 20 having a first rod end 22 and a second end 26. First rod end 22 has a bumper 24 affixed thereto. As best shown in FIG. 2, a protruding member 28 extends from rod 20 between rod ends 22, 26. While protruding member 28 is depicted as a generally cylindrical peg, other shapes and types of protruding member 28 may be used within the scope of the present invention. A handle 30 is affixed to rod 20 between rods ends 22, 26. Rod 20 and protruding member 28 may comprise a plastic, or the like, in addition to other materials. Protruding member 28 may be affixed to handle 30, to rod 20, or may be integrally formed with either, or both. Handle 30 is manipulated to position protruding member 28 at a desired location within detent 18 as further described below.

Casing 12 includes a first opening 32 through which first rod end 22 extends. Casing 12 further includes a second opening 34 through which second rod end 26 extends. In the embodiment depicted in FIGS. 1–2, casing 12 includes a third opening 36 through which handle 30 extends. To facilitate ease of use of handle 30, a stationary handle 50 is preferably affixed to casing 12. In this manner, and as further described below, the user may move handle 30 relative to stationary handle 50 to translate protruding member 28 within detent 18 as desired.

In one particular embodiment, apparatus 10 further includes a tension member 38, depicted as a coil spring 38 in FIG. 1B. Spring 38 is coupled to rod 20 near second rod end 26. For example, second rod end 26 may be inserted through the interior of spring 38. In one particular embodiment, spring 38 is positioned to be between an inner surface 46 of casing 12 and a support 48 affixed to rod 20. As shown, support 48 comprises a generally washer-shaped support 48 against which one end of spring 38 resides, although other shaped supports 48 also may be used. In this manner, spring 38 is compressed between support 48 and inner surface 46 when handle 30 is encouraged toward stationary handle 50. Correspondingly, compressed spring 38 encourages protruding member 28 towards first opening 32.

Apparatus 10 further preferably includes a second tension member 40, depicted as a tension spring 40 in FIG. 1B. The tips of tension spring 40 extend into slots 42 within handle 30. The upper surface of tension spring 40 presses against an inner surface 44 of cover 14 when cover 14 is affixed to casing 12. In this manner, tension spring 40 encourages protruding member 28 down into detent 18 as more further described in conjunction with later figures.

Figure 3A:
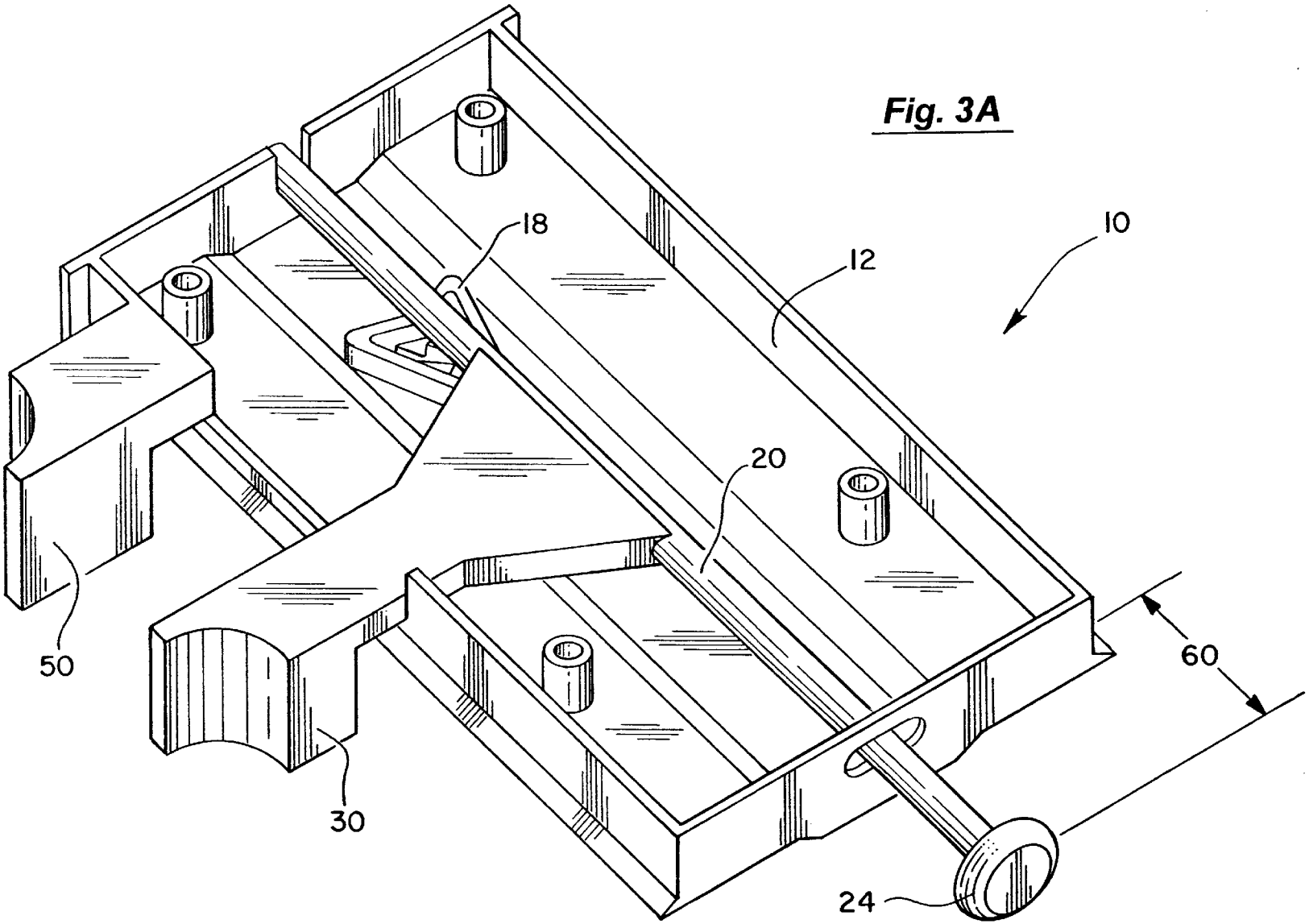
FIGS. 3A and 3B depict an overall view and a top down view, respectively, of the apparatus of FIGS. 1A–1B with the rod in a first fixed position.
Figure 3B:
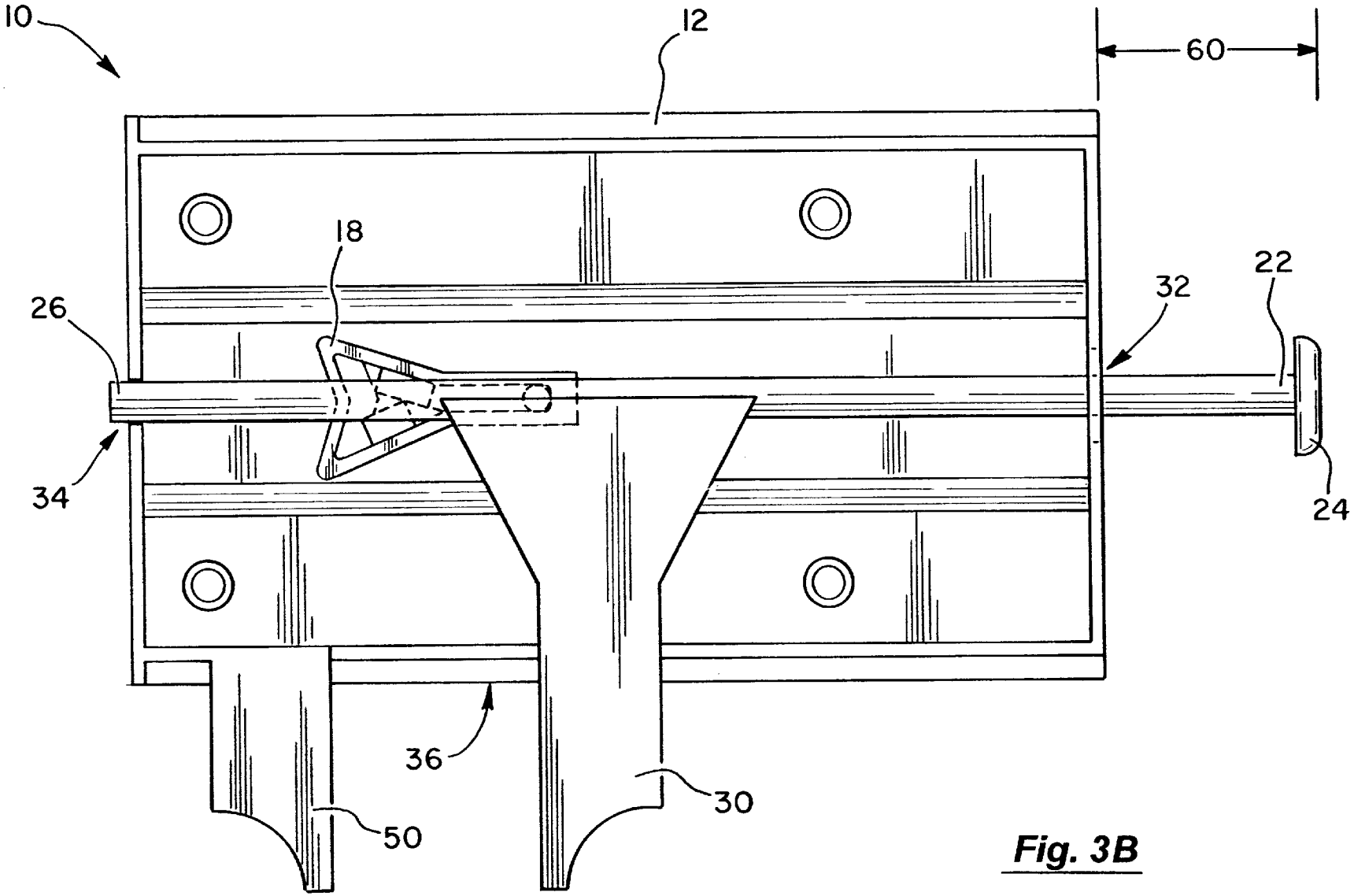

Turning now to FIGS. 3A and 3B, apparatus 10 will be described in a first fixed position. As best shown in FIG. 3B, when apparatus 10 is in first fixed position, protruding member 28 is positioned within detent 18 at the position nearest first opening 32. In this manner, bumper 24 at first rod end 22 is extended a first distance 60 from the outer edge of casing 12. In the embodiment shown, second rod end 26 slides within second opening 34 of casing 12, but does not enter casing 12 when rod 20 is in the first fixed position.

Figure 4A:
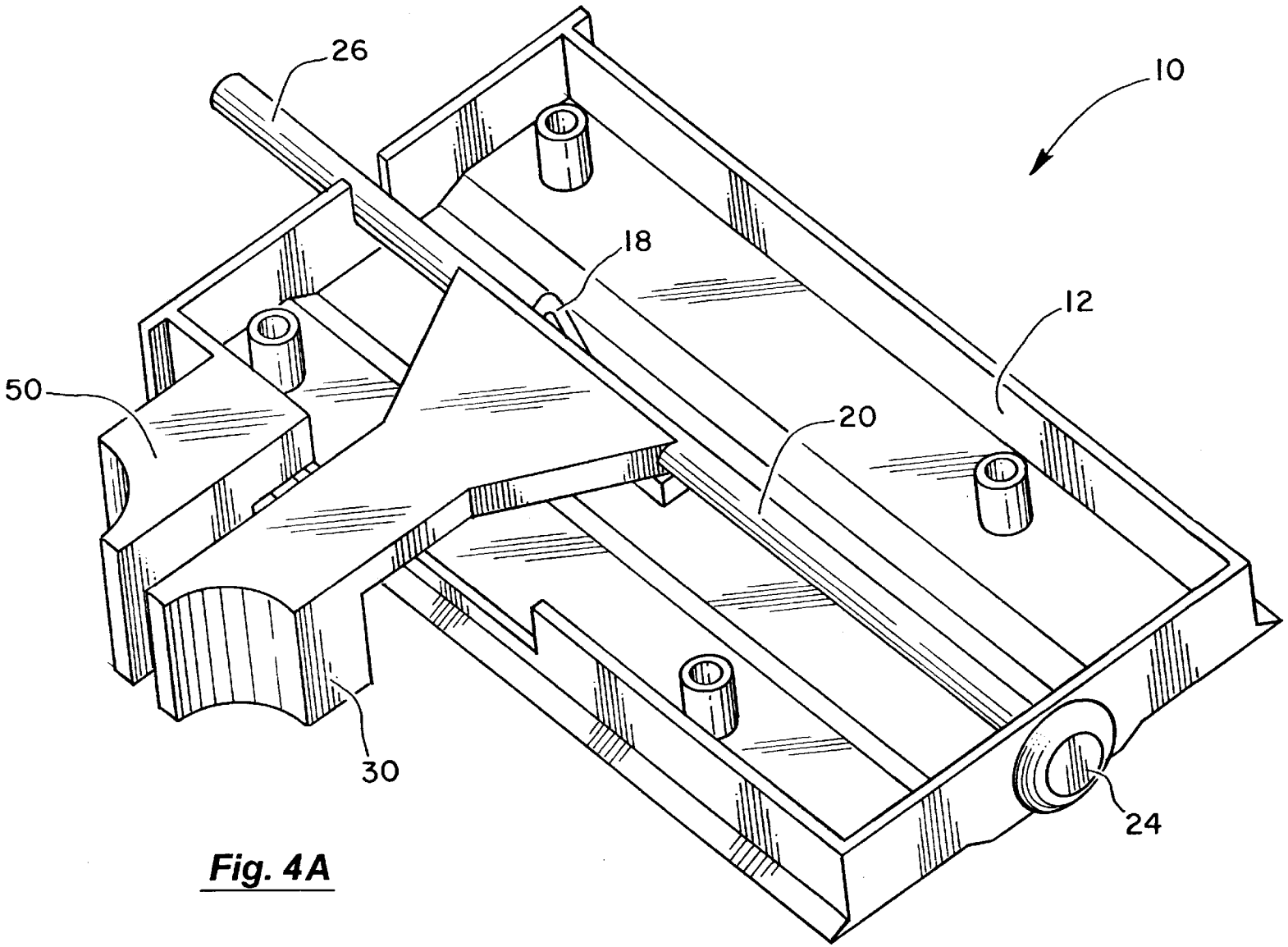
FIGS. 4A and 4B depict an overall view and a top down view, respectively, of the apparatus of FIGS. 1A–1B with the rod in a second fixed position.
Figure 4B:
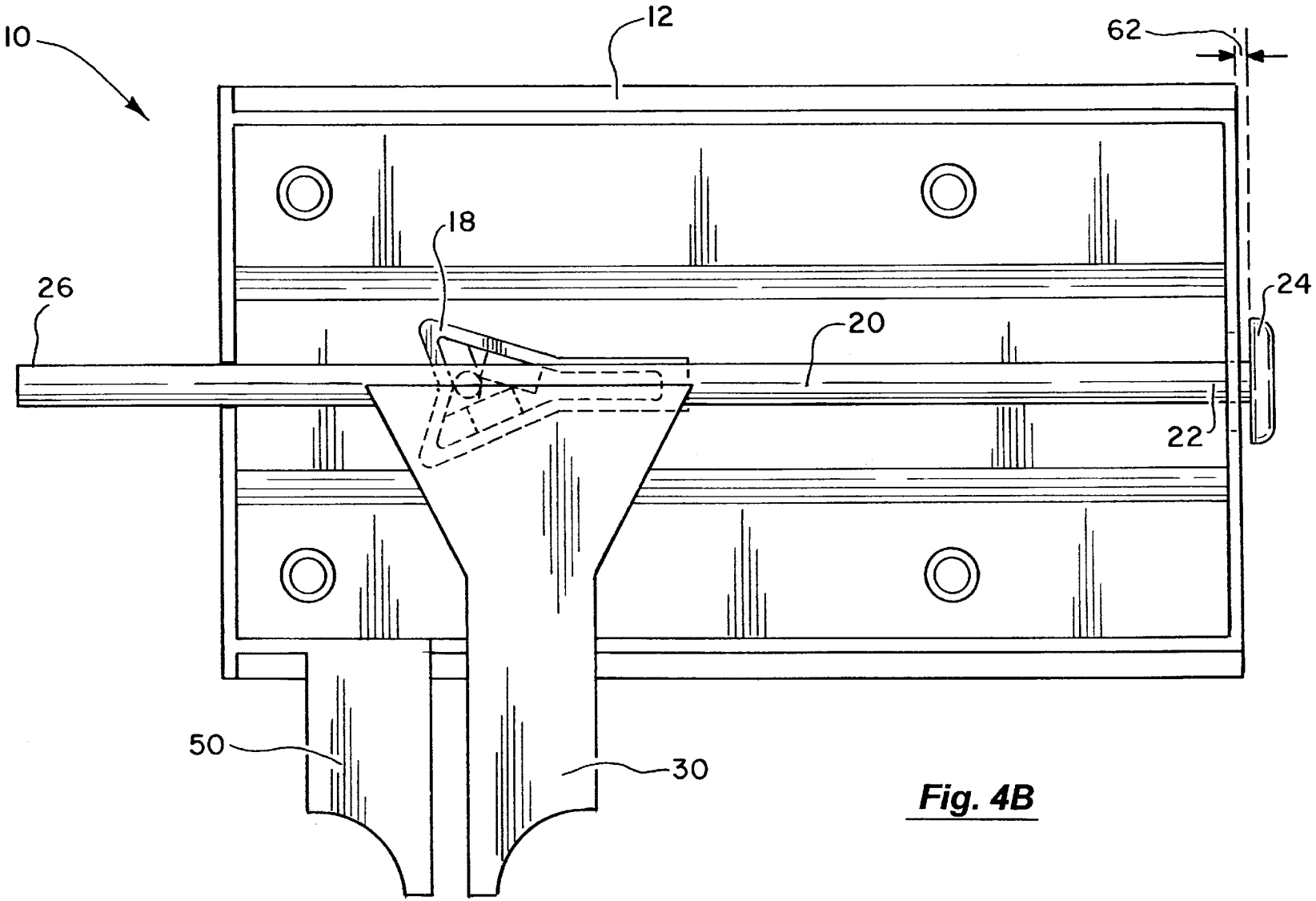

Apparatus 10 is depicted in a second fixed position in FIGS. 4A and 4B. In this configuration, bumper 24 extends a second distance 62 from the outside of casing 12. As can be seen in FIGS. 4A–4B, such a configuration brings bumper 24 closer to casing 12. In the second fixed position, second rod end 26 extends out of second opening 34 in casing 12 a greater distance than that shown in FIGS. 3A and 3B. Further, protruding member 28 is at a position within detent 18 that is closer to second opening 34 than that shown in FIGS. 3A and 3B. Similarly, handles 30 and 50 are closer together. As will be described further in conjunction with FIG. 6, such an arrangement facilitates the movement of a movable blinds rail between opposing fixed surfaces such as a window frame.

As described further in conjunction with later figures, positioning protruding member 28 in first fixed position encourages bumper 24 against a fixed surface, such as a window frame. In one embodiment, protruding member 28 will be positioned as depicted in FIG. 3B when rod 20 and protruding member 28 are in the first fixed position. In other words, first fixed position is obtained when protruding member 28 is positioned within detent 18 at the position nearest first opening 32. Alternatively, rod 20 and protruding member 28 are in the first fixed position when protruding member 28 is positioned at other locations within detent 18. This may occur, for example, when bumper 24 contacts a fixed surface before protruding member 28 reaches the position within detent 18 closest to first opening 32.

It will be appreciated by those skilled in the art that alternative arrangements of second end 26/second opening 34 also may be used. For example, in lieu of second opening 34, second rod end 26 can be configured to remain within casing 12 when rod 20 is in either first or second fixed positions. For example, second end 26 may be supported via a support member (not shown) that is affixed to an inner surface of casing 12 in lieu of second opening 34.

Figure 5A:
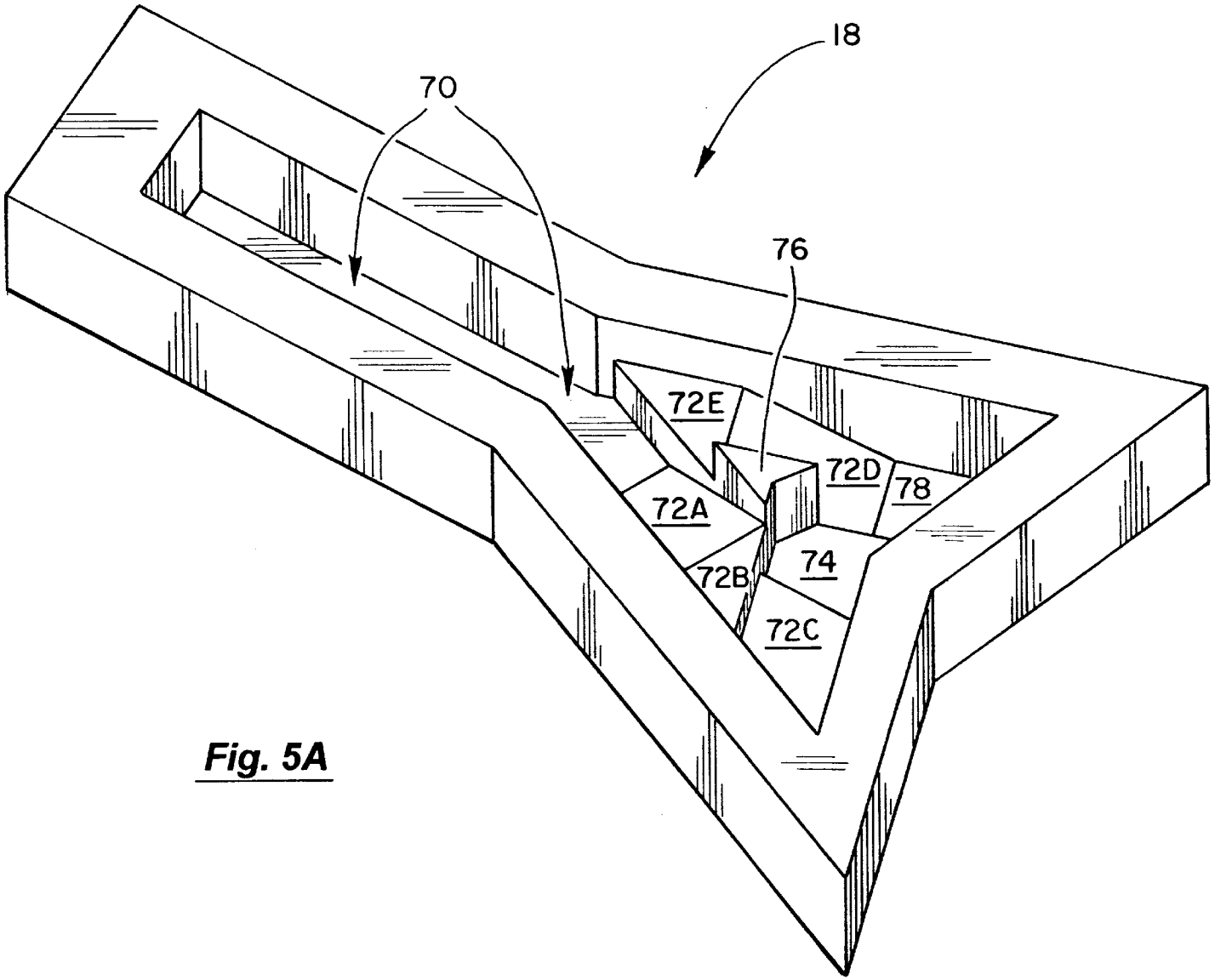
FIGS. 5A and 5B are overall views of an exemplary detent for use with apparatus and systems of the present invention.
Figure 5B:
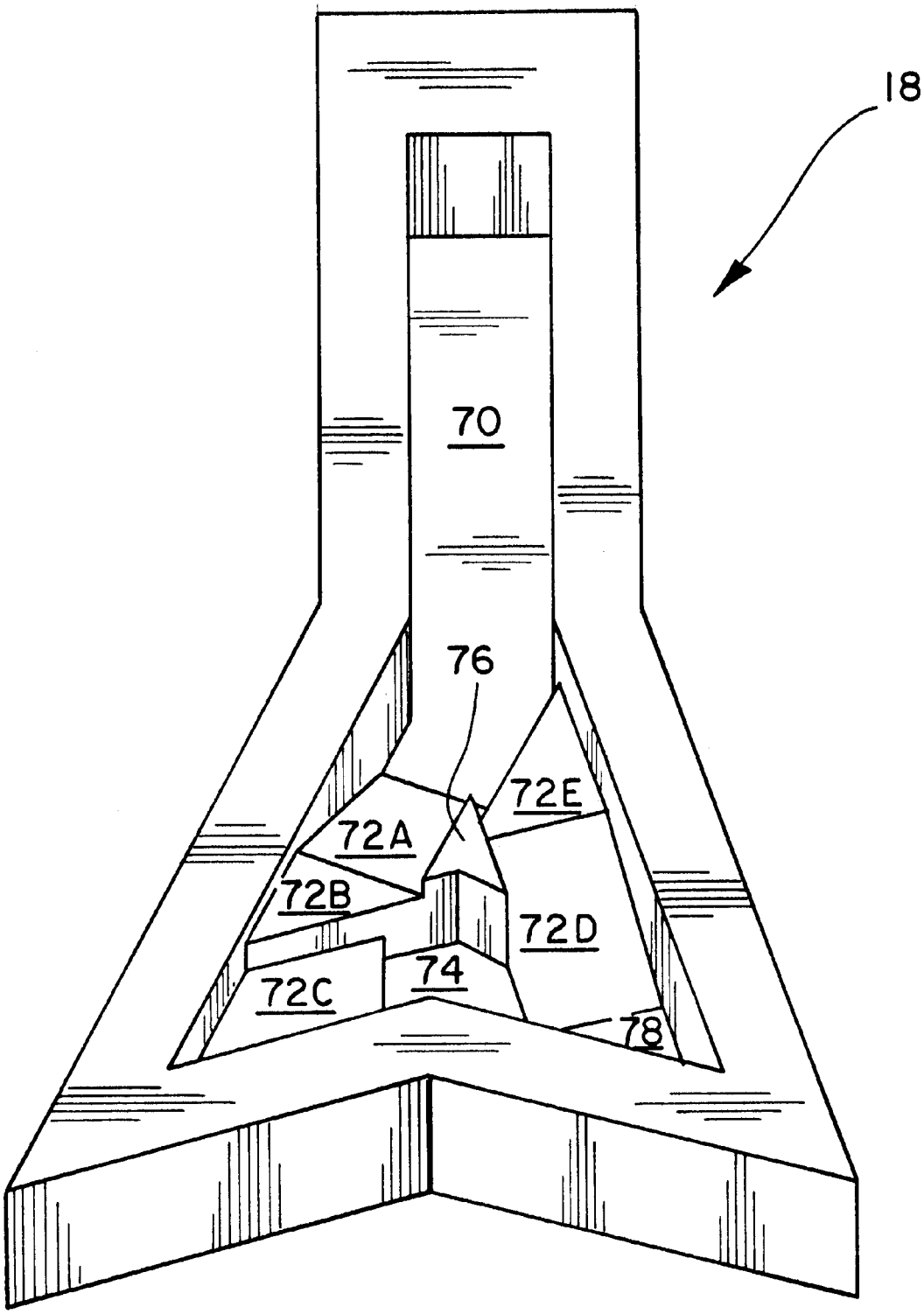

Turning now to FIGS. 5A and 5B, an exemplary detent 18 for use with apparatus of the present invention will be described. Detent 18 preferably comprises a plastic, although other materials may be used, and is affixed to the inner surface of casing 12. For example, detent 18 may be affixed using epoxy, or the like. In another embodiment, detent 18 is integrally formed with casing 12, such as by molding. Detent 18 is depicted as a generally Y-shaped detent 18, however, it will be appreciated by those skilled in the art that other shaped detents 18 may be used within the scope of the present invention.

Detent 18 includes a primary groove 70 into which protruding member 28 resides. Tension spring 40, as described in conjunction with FIGS. 1 and 2, encourages protruding member 28 down into detent 18, including primary groove 70. In this manner, protruding member 28 preferably resides within primary groove 70 when rod 20 is in the first fixed position. Detent 18 further includes a plurality of ramps 72A–72E. Use of the term ramps is not intended to imply an angular relation between ramp 72 and adjoining surfaces, and may include surfaces which are generally flat (such as ramp 72E).

In conjunction with FIGS. 5A and 5B, the translation of rod 20 from a first fixed position (as shown in FIGS. 3A–3B) to a second fixed position (as shown in FIGS. 4A–4B) will now be described. Translation of rod 20 may occur, for example, by manipulating handle 30. As previously discussed, first fixed position preferably has protruding member 28 located in primary groove 70. While depicted in FIGS. 3A and 3B as having protruding member 28 at the end of primary groove 70, it will be appreciated by those skilled in the art that protruding member 28 may be at the first fixed position somewhere along the length of primary groove 70 without being at the end of groove 70. This may occur, for example, when bumper 24 contacts a fixed surface before protruding member 28 reaches the end of groove 70.

By translating handle 30 towards stationary handle 50, protruding member 28 slides within groove 70 and is forced towards ramp 72A by the vertical face of ramp 72E. Protruding member 28 then proceeds up ramp 72A, across ramp 72B (depicted as a generally flat surface) and drops off ramp 72B onto ramp 72C. Protruding member 28 then drops off ramp 72C into a groove 74. Protruding member 28 is now in the second fixed position. Protruding member 28 is maintained in groove 74 by a stationary post 76. Protruding member 28 is encouraged against post 76 by spring 38. In this manner, rod 20 is affixed in the second fixed position.

To translate rod 20 from second fixed position (as shown in FIGS. 4A–4B) to first fixed position (as shown in FIGS. 3A–3B), handle 30 is again compressed toward stationary handle 50. Protruding member 28 drops off groove 74 onto a groove 78. Downward motions of protruding member 28 are encouraged by tension spring 40 pressing against inner surface 44 of cover 14, and hence encouraging protruding member 28 in a downward fashion. Protruding member 28 is encouraged from groove 78, up ramp 72D and onto ramp 72E (depicted as a generally flat surface) by spring 38. Spring 38 continues to encourage protruding member 28 towards and into primary groove 70, with protruding member 28 dropping off the vertical face of ramp 72E. Spring 38 then encourages protruding member 28 along primary groove 70 until rod 20 achieves a first fixed position. In this manner, detent 18 provides at least two fixed positions at which protruding member 28 is stable. Further, the configuration of grooves 70, 74 and 78 in conjunction with ramps 72A–E provide a single path along which protruding member 28 is encouraged.

It will be appreciated by those skilled in the art that the configuration of grooves and ramps described in conjunction with FIG. 5 represent but one of a large number of ramp and groove configurations which may be used within the scope of the present invention.

Turning now to FIG. 6, exemplary blinds systems according to the present invention will be described. FIG. 6A depicts a blinds system 100 having an upper end rail 110 and a lower end rail 112 with a plurality of slats 116 connected therebetween. In this embodiment, lower end rail 112 is a moveable end rail 112. It will be appreciated by those skilled in the art that the term slats 116 is not intended to limit the scope of the present invention to wood blinds or other types of venetian blinds. Further, slats 116 is intended to further include miniblinds, cloth blinds and other types of window dressing which have upper and/or lower movable end rails and which would be desirable to be secured to a fixed surface.

System 100 further includes an elevating member 118 for raising and lowering at least one of the end rails 110, 112. As shown in FIG. 6A, system 100 may further include a rotation member 120 for rotating slats, for example, to allow in—or close out—sunlight. System 100 further includes a support or supports 122 for affixing system 100 to a window frame 124 or other fixed surface. Supports 122 may include, for example, screw-in brackets and the like for affixing system 100 to window frame 124.

As shown in FIG. 6C, a similar system 100 is shown as that described in conjunction with FIG. 6A. System 100 in FIG. 6C has a movable end rail that is an upper end rail 110. For both embodiments shown in FIGS. 6A and 6C, the movable end rail 110 or 112 has blinds locking apparatus 10 affixed thereto. More specifically, blinds locking apparatus 10 are affixed to opposing ends of the movable end rail 110 or 112. As shown in FIGS. 6B and 6D, bumper 24 at first rod end 22 is positioned to contact window frame 124 or other fixed surfaces to secure movable end rail 110 or 112 thereto. While FIGS. 6A–6D depict apparatus 10 affixed to opposing ends of a single movable end rail, it will be appreciated by those skilled in the art that both upper end rail 110 and lower end rail 112 may be moveable end rails, and may each have a locking apparatus 10 affixed to opposing ends thereof.

As shown in FIG. 6B, locking apparatus 10 is affixed to an underside of movable end rail 112. Similarly, apparatus 10 may be affixed to a top side of upper end rail 110. Such an attachment may be made using screws, bolts, epoxy, and the like. Further, as shown in FIG. 6D, apparatus 10 may be affixed to movable end rail 110 or 112 in a manner which conceals apparatus 10 therein. Apparatus 10 is, in one embodiment, held in place in end rail 110, 112 by frictional contact therewith, such as by fitting within a groove (not shown) in end rail 110, 112. Alternatively, screws, epoxy, other fasteners and the like may be used.

Referring to the FIGS. 1–6, an exemplary method of operating an exemplary blind system according to the present invention will be described. The method includes providing a blinds system having a locking apparatus 10 coupled to opposing ends of a movable end rail, such as end rails 110 and/or 112. Each locking apparatus 10 is as previously described in conjunction with FIGS. 1–5. The method includes translating the elongate rod in at least one of the locking apparatus 10 so that protruding member 28 cooperates with detent 18 to secure the rod in the second fixed position. For example, handle 30 may be manipulated to slidably translate protruding member 28 within detent 18 until protruding member 28 abuts post 76 and resides on groove 74 as described in conjunction with FIGS. 5A and 5B. When at least one of apparatus 10 has rod 20 in the second fixed position, the movable end rail 110–112 is positioned at a desired location. This may be accomplished, for example, by elevating the movable end rail using elevating member 118 shown in FIG. 6A.

Once the movable end rail 110 or 112 is positioned at a desired location, which may be an infinite number of positions due to the benefits of the present invention, elongate rod 20 that had been retracted to the second fixed position is translated to the first fixed position. By translating elongate rod 20 back towards the first fixed position, protruding member 28 cooperates with detent 18 in a manner which secures rod 20 in the first fixed position. As shown in FIG. 6A and FIG. 6C, by having both opposing apparatus 10 with rods 20 in the first fixed position, bumpers 24 of each apparatus 10 press against window frame 124. In this manner, movable end rail 110 or 112 is temporarily secured to window frame 124 at a desired location.

It will be appreciated by those skilled in the art that in other embodiments, the step of positioning the movable end rail at its desired location may require the retraction of rods 20 of both apparatus 10 into second fixed position. Such an arrangement may depend, for example, upon the tightness of fit between movable end rails 110, 112 to the inside of window frame 124. Further, it will be appreciated by those skilled in the art that the first fixed position need not have protruding member 28 at the end of primary groove 70. First fixed position may occur practically anywhere along primary groove 70, and is a function of, inter alia, the fit between the outer edge of casing 12 and the inside of window frame 124.

The invention has now been described in detail. However, it will be appreciated that certain changes and modifications may be made. For example, while described in conjunction with a window frame, it will be appreciated that the apparatus and systems of the present invention may be used to affix blinds to other fixed surfaces, for example, doors. Therefore, the scope and content of this invention are not limited by the foregoing description. Rather, the scope and content are to be defined by the following claims.

What is claimed is:

1. An apparatus for securing a moveable blinds rail to a fixed surface, comprising:

a casing having a detent affixed to any inner surface thereof;

an elongate rod having first and second ends and a protruding member extending from said rod between said ends, said first rod end extending out of a first opening of said casing, said elongate rod further comprising a handle extending from between said ends, said handle extending out of said casing through a second opening in said casing; and said protruding member slidably cooperating with said detent to secure said rod in a first fixed position.

2. An apparatus as in claim 1, wherein said detent comprises a generally Y-shaped detent.

3. An apparatus as in claim 1, wherein said casing further comprises a third opening through which said second rod end extends.

4. An apparatus as in claim 1, wherein said detent comprises a plurality of ramps defining a plurality of grooves, said protruding member slidably cooperating with said ramps and said grooves to position said rod in said first fixed position.

5. An apparatus as in claim 4, wherein said protruding member slidably cooperates with said ramps and said grooves to position said rod in a second fixed position.

6. An apparatus as in claim 5, wherein said first and said second fixed positions correspond to said first rod end being extended from said casing a first and a second distance, respectively.

7. An apparatus as in claim 1, further comprising a tension member coupled to said rod near said second end, said tension member adapted to encourage said protruding member towards said first opening so that said rod is in said first fixed position.

8. An apparatus as in claim 5, further comprising a tension member coupled to said rod near said second end, said tension member adapted to encourage said protruding member towards said first opening so that said rod is in said second fixed position.

9. An apparatus as in claim 7, wherein said tension member comprises a spring.

10. An apparatus as in claim 7, wherein said tension member engages an inner edge of said casing to encourage said protruding member towards said first opening.

11. An apparatus as in claim 1, further comprising a tension member coupled to said rod, said tension member adapted to encourage said protruding member into said detent.

12. A blinds system comprising:

first and second end rails having a plurality of connected slats therebetween;

a flexible elevating member for changing an elevation of said first end rail; and first and second locking apparatus coupled to opposing ends of said first end rail, each of said locking apparatus comprising a casing having a detent affixed to an inner surface thereof; and an elongate rod having first and second ends and a protruding member extending from said rod between said ends, said first rod end extending out of a first opening of said casing, said elongate rod further comprising a handle extending from between said ends, said handle extending out of said casino through a second opening in said casing;

said protruding member slidably cooperating with said detent to secure said rod in a first fixed position.

13. A blinds system as in claim 12, wherein said first end rail is a moveable lower end rail.

14. A blinds system as in claim 12, wherein said first end rail is a moveable upper end rail.

15. A blinds system as in claim 12, wherein said locking apparatus each further comprise a tension member coupled to said rod near said second end, said tension member adapted to encourage said protruding member towards said first opening so that said rod is in said first fixed position.

16. A blinds system as in claim 12, wherein said first rod ends engage opposing fixed surfaces to secure said first end rail thereto when said rods are secured in said first fixed positions.

17. A blinds system as in claim 16, wherein said opposing fixed surfaces comprise opposing surfaces of a window frame.

18. A blinds system as in claim 16, wherein said protruding members slidably cooperate with said detent to secure each of said rods in a second fixed position, and wherein said first end rail moves generally freely relative to said opposing fixed surfaces when at least one of said rods is in said second fixed position.

19. A blinds system as in claim 12, further comprising a rotation member for rotating said connected slats.

20. A method of securing a moveable end rail of a blinds system to a fixed surface, said method comprising:

providing a locking apparatus coupled to each opposing end of said moveable end rail, each of said locking apparatus comprising a casing having a detent affixed to an inner surface thereof; and an elongate rod having first and second ends and a protruding member extending from said rod between said ends, said first rod end extending out of a first opening of said casing, said elongate rod further comprising a handle extending from between said ends, said handle extending out of said casing through a second opening in said casing;

said protruding member slidably cooperating with said detent to secure said rod in first and second fixed positions;

translating said elongate rod in at least one of said locking apparatus so that said protruding member cooperates with said detent to secure said rod in said second fixed position;

positioning said moveable end rail at a desired location; and translating, using said handle, said elongate rod in said at least one of said locking apparatus so that said protruding member cooperates with said detent to secure said rod in said first fixed position so that said first rod ends contact opposing fixed surfaces to secure said moveable end rail at said desired location.

21. A method as in claim 20, wherein said locking apparatus each further comprise a tension member coupled to said rod near said rod second end, said tension member adapted to encourage said protruding member towards said first opening so that said rod is in said first fixed position.

22. A method as in claim 20, wherein said detents in said locking apparatus each further comprise a plurality of ramps defining a plurality of grooves, said protruding member slidably cooperating with said ramps and said grooves to position said rod in said first and second fixed positions.

23. A blinds system comprising:

first and second end rails having a plurality of connected slats therebetween;

a flexible elevating member for changing an elevation of said first end rail; and first and second locking apparatus coupled to opposing ends of said first end rail, each of said locking apparatus comprising a casing having a detent affixed to a generally flat inner surface thereof, said detent having a plurality of ramps defining a plurality of grooves; and an elongate rod having first and second ends and a protruding member extending from said rod between said ends, said first rod end extending out of a first opening of said casing;

said protruding member slidably cooperating with said detent to secure said rod in a first fixed position.

24. A blinds systems as in claim 23 wherein said protruding member slidably cooperates with said detent to secure said rod in a second fixed position by a generally linear translation of said rod from said first fixed position.

* * * * *

UNITED STATES PATENT AND TRADEMARK OFFICE

CERTIFICATE OF CORRECTION

PATENT NO. : 6,186,214 B1
DATED : February 13, 2001
INVENTOR(S) : Kevin Ladd and David Boyer It is certified that error appears in the above-identified patent and that said Letters Patent is hereby corrected as shown below:

Column 8, line 54, and Column 9, line 3,

12. A blinds system comprising:

first and second end rails having a plurality of connected slats therebetween;

a flexible elevating member for changing an elevation of said first end rail; and first and second locking apparatus coupled to opposing ends of said first end rail, each of said locking apparatus comprising a casing having a detent affixed to an inner surface thereof;and an elongate rod having first and second ends and a protruding member extending from said rod between said ends, said first rod end extending out of a first opening of said casing, said elongate rod further comprising a handle extending from between said ends, said handle extending out of said [casino] casing through a second opening in said casing;

Signed and Sealed this

Eighth Day of January, 2002

*Attest:*

*Attesting Officer*

JAMES E. ROGAN
*Director of the United States Patent and Trademark Office*